US006203221B1

(12) United States Patent
Tomasik et al.

(10) Patent No.: US 6,203,221 B1
(45) Date of Patent: Mar. 20, 2001

(54) MODULAR PRINTER

(75) Inventors: John A. Tomasik, Littleton, CO (US); Keith Jentoft, Circle Pines, MN (US); Mark W. Moore, Highlands Ranch, CO (US)

(73) Assignee: Axiohm Transaction Solution, Inc., Ithaca, NY (US)

( * ) Notice: Subject to any disclaimer, the term of this patent is extended or adjusted under 35 U.S.C. 154(b) by 0 days.

(21) Appl. No.: 09/413,964

(22) Filed: Oct. 7, 1999

(51) Int. Cl.[7] ..... B41J 3/36

(52) U.S. Cl. ..... 400/88; 400/613; 347/108; 347/222; 347/2; 235/472.01; 235/472.02; 235/472.03; 235/462.47; 101/288

(58) Field of Search ..... 400/88, 613, 693; 101/288; 347/108, 109, 222, 2; 235/472.01, 472.02, 472.03, 462.47, 432; 455/90, 94

(56) References Cited

U.S. PATENT DOCUMENTS 4,706,096 * 11/1987 Sato ..... 347/222
4,727,245 * 2/1988 Dobbins et al. ..... 400/88
4,734,710 * 3/1988 Sato et al. ..... 101/288
4,746,932 * 5/1988 Sato ..... 101/288
4,757,329 * 7/1988 Sato et al. ..... 347/222
4,962,430 * 10/1990 Hiroki et al. ..... 400/88
5,033,882 * 7/1991 Vanderpool et al. ..... 400/88
5,047,615 * 9/1991 Fukumoto et al. ..... 235/432
5,055,660 * 10/1991 Bertagna et al. ..... 235/472.02
5,163,766 * 11/1992 Fushimi et al. ..... 400/88
5,237,487 * 8/1993 Dittmer et al. ..... 400/693
5,449,238 * 9/1995 Pham et al. ..... 400/88
5,542,487 * 8/1996 Schultz et al. ..... 347/2
5,682,191 * 10/1997 Barrett et al. ..... 347/108
5,802,459 * 9/1998 Burke et al. ..... 455/94
5,859,414 * 1/1999 Grimes et al. ..... 235/383
5,918,989 * 7/1999 Stout, Jr. et al. ..... 400/88
5,933,812 * 8/1999 Meyer et al. ..... 235/483
5,997,193 * 12/1999 Petterutti et al. ..... 400/88
6,030,133 * 2/2000 Endo ..... 400/88
6,065,679 * 5/2000 Levie et al. ..... 235/462.47

* cited by examiner

*Primary Examiner*—Eugene Eickholt
(74) *Attorney, Agent, or Firm*—Salzman & Levy

(57) ABSTRACT

A modular printer that can be configured to provide different printing sizes, models, and features. The modular printer has a base module that includes base printing electronics, and a drive and print mechanism. Coupled to the base module are different communication modules that provide an interface for the operator of the printer. Different battery modules are designed to interface with the other modular sections.

14 Claims, 1 Drawing Sheet

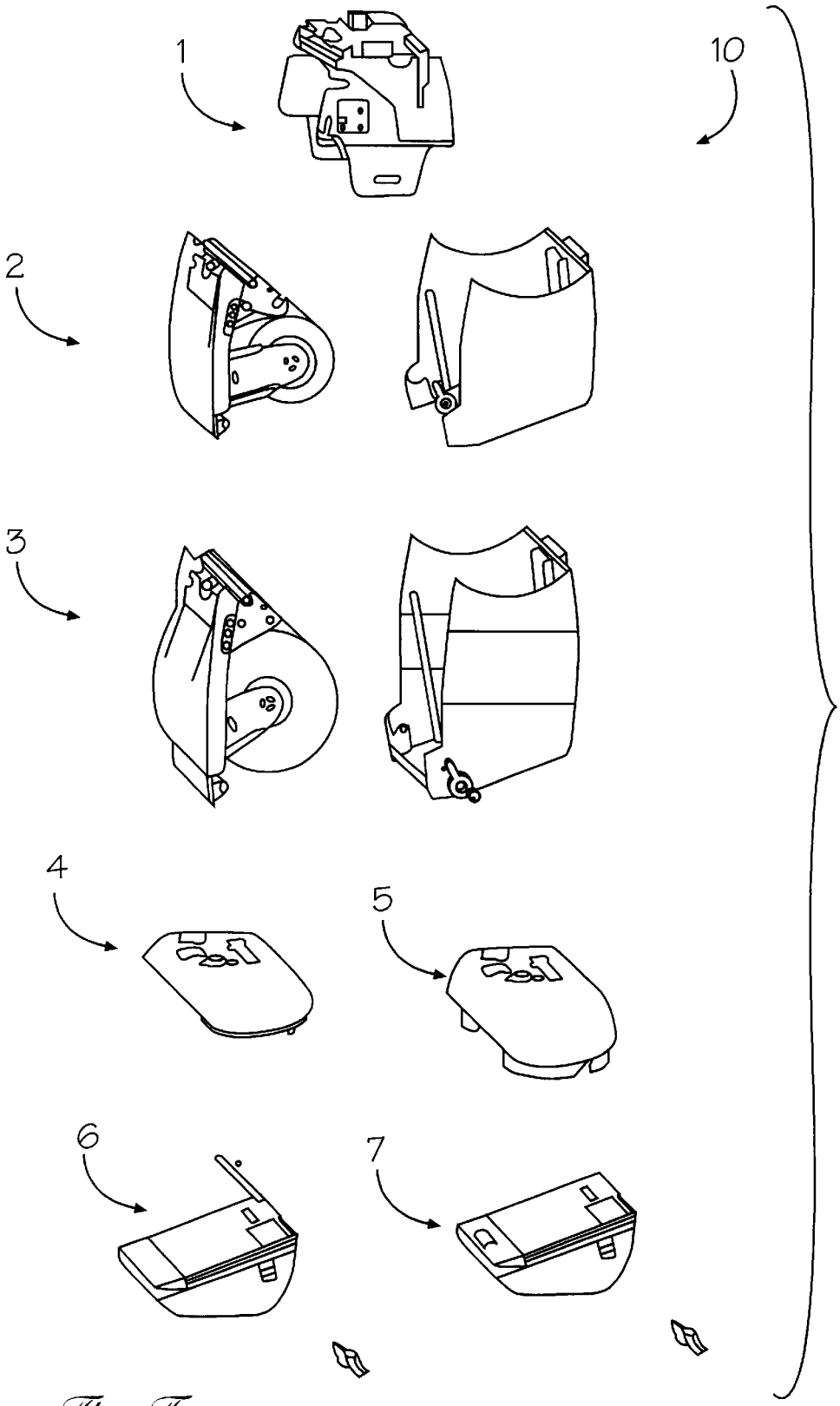
The Figure

MODULAR PRINTER

FIELD OF THE INVENTION

The invention relates to printing devices and, more particularly, to a modular printer that can be configured for different operations, interchangeability, and expandability by the end user, repair depot, or other, allowing the printer to evolve with individual application requirements.

BACKGROUND OF THE INVENTION

Most companies that manufacture commercial and retail printers have a line of different models to meet different business operations and technologies. The manufacture of printing devices is a highly competitive field, requiring costs to be pared as greatly as possible. Having to fabricate different types of printing devices allows for some cost cutting, by using identical parts in several different models. However, the different requirements of each printing operation, and the different technologies involved usually do not allow for much interchangeability of parts. Hence, manufacturers have a large inventory of different printer sizes and models.

The present invention seeks to provide a modular printer, the design of which allows for ease of configuration to different feature sets, different operations, and different technologies.

The modular printer of this invention comprises a base module that contains the base printing electronics, and a drive and print mechanism. This base module can be paired with two different media cavities: (1) a cavity for accommodating a two inch paper supply roll; and (2) a cavity for supporting a three and one-quarter inch supply roll. The smaller, two inch cavity, naturally, can be used in one of the smallest sized printers, while the three and one-quarter inch cavity can be employed for one of the largest printers in the industry.

Coupled to the base module is a communications module that provides an interface for the operator of the printer. The communications module itself can be configured, so that more than one interface can be interchanged with the base module. The module can be designed to provide a simple or sophisticated interface. The communication module can be configured for RF capability, an expanded keyboard, a display, a magnetic stripe reader, and a parallel interface. Electrical connectivity is achieved through a standard communications bus [$I^2C$]. This allows for expandability by the end user, repair depot, or other, allowing the printer to evolve with individual application requirements.

The battery modules are also designed to interface with the other modular sections, in order to allow for expandability in the future. Provisional contacts between the battery module and the printing mechanism provide a means by which different battery types, such as NiCad, NiMH, Li ion, lead acid, polymer, etc., can be employed. This is accomplished through electronic battery identification means. The provisional contacts also provide a means for assessing the charging status (coulomb counter) for each battery.

The interchangeability provided by the modularized printer of this invention greatly reduces the cost of manufacture, and the costs associated with carrying a large line of printer models. In addition, the modular design provides for quick changeovers to new and more sophisticated printing models, as well as allowing upgrading, or addition of the latest technological user features.

SUMMARY OF THE INVENTION

In accordance with the present invention, there is provided a modular printer that can be configured to provide different printing sizes, models, and features. As the design allows for the user, repair depot, or other entity to configure it, the essential advantage is that the printer can evolve with the application. The modular printer comprises a base module that includes base printing electronics, and a drive and print mechanism. The base module can be paired with different media cavities. Coupled to the base module is a communications module that provides an interface for the operator of the printer. The communications module itself can be configured so that more than one interface can be interchanged with the base module.

Electrical connectivity is achieved through a standard communications bus [$I^2C$]. This allows for expandability, so that add-ons may be included in the future, or current user features can be changed. The battery modules are also designed to interface with the other modular sections, in order to allow for expandability in the future. Provisional contacts between the battery module and the printing mechanism provide a means by which different battery types, such as NiCad, NiMH, Li ion, lead acid, polymer, etc., can be employed. The provisional contacts also provide a means for assessing the charging status (coulomb counter) for each battery.

It is an object of this invention to provide a modular printer that can be configured to provide a line of different printer models through the interchange of different modular sections.

It is another object of the invention to provide a modularized printer having interchangeable sections that allow for expandability by the end user, repair depot, or other, allowing the printer to evolve with individual application requirements.

BRIEF DESCRIPTION OF THE DRAWINGS

A complete understanding of the present invention may be obtained by reference to the accompanying drawings, when considered in conjunction with the subsequent detailed description, in which:

The FIGURE illustrates an exploded, perspective view of the modular, interchangeable sections of the modularized printer of this invention.

DESCRIPTION OF THE PREFERRED EMBODIMENT

Generally speaking, the invention features a modular printer that can be configured to provide different printing sizes, models, and features. The modular printer comprises a base module that includes base printing electronics, and a drive and print mechanism. Coupled to the base module are different communication modules that provide an interface for the operator of the printer. Different battery modules are designed to interface with the other modular sections.

Now referring to the FIGURE, an exploded, perspective view is illustrated of the modular, interchangeable sections of the modularized printer 10 of this invention.

The modularized printer 10 comprises a base module 1 that contains the base printing electronics, and a drive and print mechanism. This base module 1 can be paired with two different media cavities: (a) a cavity 2 for supporting a two inch paper supply roll; and (b) a cavity 3 for holding a three and one-quarter inch supply roll. The smaller, two inch cavity 2, naturally, can be used in one of the smallest sized printers (not shown), and the three and one-quarter inch cavity 3 can be employed for one of the largest printers in the industry.

Coupled to the base module 1 is a standardized communications module 4 that provides an interface for the operator (not shown) of the printer. The communications module 4 itself can be configured so that more than one interface can be interchanged with the base module 1. The module 4 can be designed to provide a simple or sophisticated interface. The communication module 4 can be configured for RF capability, an expanded keyboard, a display, a magnetic stripe reader, and a parallel interface.

Electrical connectivity is achieved through a standard communications bus [$I^2C$]. This allows for expandability, so that add-ons may be included in the future.

The respective battery modules 6 and 7 are designed to interface with the other modular sections, in order to allow for expandability in the future. Provisional contacts between the battery modules 6 or 7, respectively, and the printing mechanism of module 1, provide a means by which different battery types, such as NiCad, NiMH, Li ion, lead acid, polymer, etc., can be employed. This is accomplished through electronic battery identification means, not shown. The provisional contacts also provide a means for assessing the charging status (coulomb counter) for each battery.

The interchangeability provided by the modularized printer 10 of this invention greatly reduces the cost of manufacture, and the costs associated with carrying a large line of printer models. In addition, the modular design provides for quick changeovers to new and more sophisticated printing models, and allows upgrading or addition of the latest technological user features.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A modular printer that can be configured to provide different printer sizes, models, and features, comprising:

a base module including base printing electronics, and a drive and print mechanism, said base module being interchangeable with different media cavities that hold different supply media;

a communications module coupled to said base module, said communications module including an interface for an operator of the printer, said communications module having a standard communications bus; and a power module that operatively couples to said base module, said power module having provisional contacts with said printing mechanism to provide means by which different power sources can be employed in said modular printer.

2. The modular printer in accordance with claim 1, wherein said communications module is configureable to receive more than one interface.

3. The modular printer in accordance with claim 1, wherein said power module comprises a chargeable battery.

4. The modular printer in accordance with claim 3, wherein said chargeable battery is selected from a group consisting of: NiCad, NiMH, Li ion, lead acid, and polymer batteries.

5. The modular printer in accordance with claim 3, wherein contacts of said battery comprise means for assessing a charging status of said battery.

6. The modular printer in accordance with claim 1, wherein each of said different media cavities comprises a predetermined size of paper supply rolls.

7. The modular printer in accordance with claim 1, wherein said communication module can be configured for RF capability, an expanded keyboard, a display, a magnetic stripe reader, and a parallel interface.

8. A modular printer that can be configured to provide different printer sizes, models, and features, comprising:

a base module including base printing electronics, and a drive and print mechanism, said base module being interchangeable with different media cavities that hold different supply media;

a communications module coupled to said base module, said communications module including an interface for an operator of the printer, said communications module having a standard communications bus; and a battery module that operatively couples to said base module, said battery module having provisional contacts with said printing mechanism to provide means by which different power can be employed in said modular printer.

9. The modular printer in accordance with claim 8, wherein said communications module is configureable to receive more than one interface.

10. The modular printer in accordance with claim 8, wherein said battery is chargeable, and is selected from a group consisting of: NiCad, NiMH, Li ion, lead acid, and polymer batteries.

11. The modular printer in accordance with claim 10, wherein contacts of said battery comprise means for assessing a charging status of said battery.

12. The modular printer in accordance with claim 8, wherein each of said different media cavities comprises a given size of paper supply rolls.

13. The modular printer in accordance with claim 8, wherein said communication module can be configured for RF capability, an expanded keyboard, a display, a magnetic stripe reader, and a parallel interface.

14. The modular printer in accordance with claim 11, wherein said means for assessing the charging status of the battery comprises a coulomb counter.

* * * * *